United States Patent [19]

Mochimaru et al.

[11] Patent Number: 4,753,543

[45] Date of Patent: Jun. 28, 1988

[54] ELECTROSTATIC PRINTING APPARATUS WITH HEATED ADJUSTABLE PRESSURE TONER FIXING ROLLS

[75] Inventors: Hideaki Mochimaru, Yokohama; Hiroyuki Idenawa, Hiratsuka; Nobuhiro Makita, Tokyo; Yoshiaki Tanaka, Kawasaki; Masayoshi Miyamoto, Yokohama; Hajime Kanda, Ayase, all of Japan

[73] Assignee: Ricoh Company, Ltd., Tokyo, Japan

[21] Appl. No.: 870,706

[22] Filed: Jun. 4, 1986

[30] Foreign Application Priority Data

| | | | |
|---|---|---|---|
| Jun. 24, 1985 | [JP] | Japan | 60-135983 |
| Jun. 24, 1985 | [JP] | Japan | 60-135984 |
| Jun. 24, 1985 | [JP] | Japan | 60-135985 |
| Jun. 24, 1985 | [JP] | Japan | 60-135986 |

[51] Int. Cl.[4] ..... B41J 3/02

[52] U.S. Cl. ..... 400/119; 430/98; 355/3 FU; 118/60; 427/14.1; 432/60; 346/762

[58] Field of Search ..... 400/119; 430/98–99, 430/124, 33, 48; 432/60; 118/59–60, 76, 115–116; 100/169–171; 355/3 FU, 14 FU; 427/11, 14.1; 346/76 L

[56] References Cited

U.S. PATENT DOCUMENTS

| | | | |
|---|---|---|---|
| Re. 32,126 | 4/1986 | Sasaki | 100/158 R |
| 3,874,843 | 4/1975 | Fujimoto | 432/60 |
| 3,941,085 | 3/1976 | Hattler | 118/60 |
| 3,988,061 | 10/1976 | Root | 430/98 |
| 4,281,623 | 8/1981 | Kato | 430/98 |
| 4,305,330 | 12/1981 | Ogihara | 430/98 |
| 4,389,114 | 6/1983 | Websterman | 355/3 FU |
| 4,439,462 | 3/1984 | Tarumi et al. | 427/14.1 |
| 4,563,075 | 1/1986 | Mosholder | 355/3 FU |
| 4,592,986 | 9/1986 | Nelson | 430/98 |
| 4,657,416 | 4/1987 | Magnenet | 400/119 |

*Primary Examiner*—E. H. Eickholt

*Attorney, Agent, or Firm*—Cooper & Dunham

[57] ABSTRACT

An electrostatic printing apparatus capable of printing both normal sheets of paper and composites such as envelopes. In accordance with a mode in which normal sheets are printed and with the other mode in which envelopes are printed, transfer current applied to a transfer charger, fixing pressure applied to between a pair of fixing rollers, and heat generation of the heat source(s) in the fixing roller(s) can be changed respectively to those suitable for the sort of a transfer member. This change can be performed manually, or controlled automatically based on a signal issued from a member sorting sensor disposed in a paper supply portion.

14 Claims, 7 Drawing Sheets

ELECTROSTATIC PRINTING APPARATUS WITH HEATED ADJUSTABLE PRESSURE TONER FIXING ROLLS

FIELD OF THE INVENTION AND RELATED ART STATEMENT

This invention relates to an electrostatic printing apparatus.

Recently, the means adapted for addressing mail envelopes, wherein address information is stored in memory, read out as electric signals, and inputted into a printer so as to print out letters corresponding to the electric signals, has been popular. Although the printer can print very fast, its use is usually limited only up to sheets of paper as thck as normal printing paper, and it is difficult to print letters on such sheets as envelopes which are made of two or more sheets and hard to bend freely. When envelopes are addressed, it is a present practice that addresses are printed on normal sheets and each of the printed addresses is cut into an appropriate size of sheet to attach it on individual envelopes. This can bring about a dreadful loss of operating efficiency.

On the other hand, such electrostatic printing apparatus as laser printer, in which toner images corresponding to information signals are formed on a photosensitive member, and transferred to transfer printing paper, as well as the transferred toner images are heated and fused on the transfer paper to fix them, have also following problems, when printing paper envelopes made of two or more sheets, paper products binding two or more sheets, and a sheet of paper of considerable thickness.

The first problem relates to the transfer of toner images on the photosensitive member. Transfer of toner images is normally carried out by charging with electricity the surface reverse to a printing surface of a transfer printing paper using corona discharger, and by absorbing electrostatically the toner images on the photosensitive member onto the printing surface of the transfer sheet. But, with printing papers made of two or more sheets put together, the surface to be transferred with toner is too far away to store a desirable charge, since not only the paper is too thick as a whole but also air layers are formed between sheets, thus causing unsatisfactory transfer. It is the same way as above with a very thick sheet of transfer paper.

The second problem resides in the possibility that paper crumples due to pressure or is torn apart by inner air pressure gathering in the rear portion, when the heating roller type fixing device consisting of a pair of heating roller and pressure roller in pressure contact with each other is used, or when envelopes are passed through between the pair of rollers in contact with each other at a fixing pressure appropriate to fixing a normal sheet of paper. The top end is hard for the nip of the roller to pick up, which may sometimes cause timing lag. Further, difference in temperature between the surface of sheet in contact with the heat fixing roller and its reverse surface in contact with the pressure roller causes a difference in thermal expansion, resulting in the deformation of envelope, which yields crumples or folding lines on it while it is being pressed.

OBJECT AND SUMMARY OF THE INVENTION

It is the object and purpose of the invention to provide an electrostatic printing apparatus which can successfully transfer and fix addresses or other letters not only on normal sheets but also on envelopes etc., to eliminate above mentioned problems associated with the case when transfer printing paper such as envelopes or those bound with two or more sheets is printed.

To achieve satisfactory fixing in printing not only normal sheets but also envelopes etc., the apparatus according to the invention comprises means for changing fixing pressure applied to between a pair of rollers in a fixing device according to transfer printing paper to be used, that is, from one pressure appropriate for a normal sheet to the other lower pressure for combined sheets.

Aforesaid means for changing the fixing pressure may be a knob turned manually or a device having a detection means for the sort of transfer printing paper to be used, along with a control means for the change of fixing pressure according to the detection signal issued from aforesaid detection means.

Still more satisfactory fixing becomes possible, by providing means for changing heat out of aforesaid heat source in addition to the means for switching the fixing pressure applied to between the pair of rollers in the fixing device, as well as means for interlocking both the fixing pressure and the heat, so as to set the fixing pressure to a given high value as well as the heat to a given high value when a normal sheet of paper is transferred, and, on the other hand, to set the fixing pressure to a given low value as well as the heat to a given high value when a combination made of two or more sheets of paper is transferred.

In this case, changing may also be carried out by the manual knob, or by automatic control according to the detection signal corresponding to a size of paper to be transferred.

If each of the pair of rollers in the fixing device is given heat source so that only one of the heat sources is energized when a normal sheet is printed, and on the other hand, both of the two are energized when a combination of two or more sheets is printed, deformation caused by a difference in thermal expansion between the upper and lower sides of transfer printing paper can be effectively eliminated, especially when envelopes are fixed.

With the purpose of obtaining satisfactory transfer and fixing either when a normal sheet of paper is printed or when envelopes are printed, it is advisable to provide means for switching transfer current of the transfer charger between one value suitable for normal paper and the other for a combination of a plurality of paper, means for switching fixing pressure applied to between aforesaid pair of rollers between respective values suitable for aforesaid two kinds of paper, means for detecting the sort of transfer printing paper to be used, and means for controlling, based on the detection signal, aforesaid transfer current and fixing pressure to a value suitable for the sort of transfer printing paper represented by the detection signal.

BRIEF DESCRIPTION OF THE DRAWINGS

In the accompanying drawings, there are shown illustrative embodiments according to the invention from which these and other of its objectives, novel features and advantages will be readily apparent.

In the drawings.

DETAILED DESCRIPTION OF THE PREFERRED EMBODIMENTS

Figure 1:
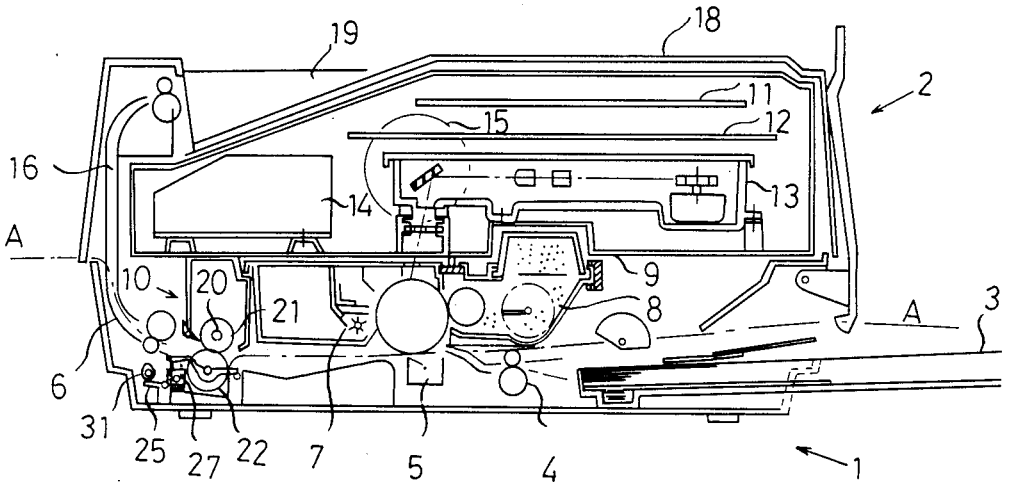
FIG. 1 is a sectional view showing a general configuration of an embodiment of an electrostatic printing apparatus according to the invention.

The following is detailed description of the preferred embodiments, referring to the drawings.

FIG. 1 shows a typical configuration of an embodiment of an laser printer according to the invention.

This laser printer consists of a lower unit 1 and an upper unit 2. Both units 1 and 2 are put together at its back side, and formed as clamshell wide opening its mouth at its front side, when viewed from the operator. A chain line A—A in FIG. 1 is a partition line of both units. The lower unit 1 accomodates a sheet supply portion 4 of sheets of transfer paper 3, a transfer charger 5 and a sheet carry portion 6 of already transferred sheets. The upper unit 2 contains an electrostatic printing section consisting of a photosensitive unit 7, a developing unit 8, a toner tank 9, and a fixing device 10, as well as electrical and electronics parts such as a sequence board to control the sequence of machinery, an interface with a host computer, two sheets of substrate for a controller 12 to control the generation of characters, a laser optical system unit 13, an electric power source 14 to supply power to all units and devices, and a main motor 15 etc., and a sheet reverse discharge unit 16. A cover 18 overlying the upper unit 2 is designed removable, the top surface of which also serves as a sheet stacker 19 for transferred sheets discharged from the sheet reverse discharge unit 16.

The fixing device 10 is constructed as a heating roller fixing device consisting of a fixing roller 21 with a heater 20 therein and a pressure roller 22 in pressure contact therewith.

The fixing pressure between the fixing roller 21 and the pressure roller 22 is variable so that the fixing pressure for envelope is lower than that for normal sheets.

Figure 2:
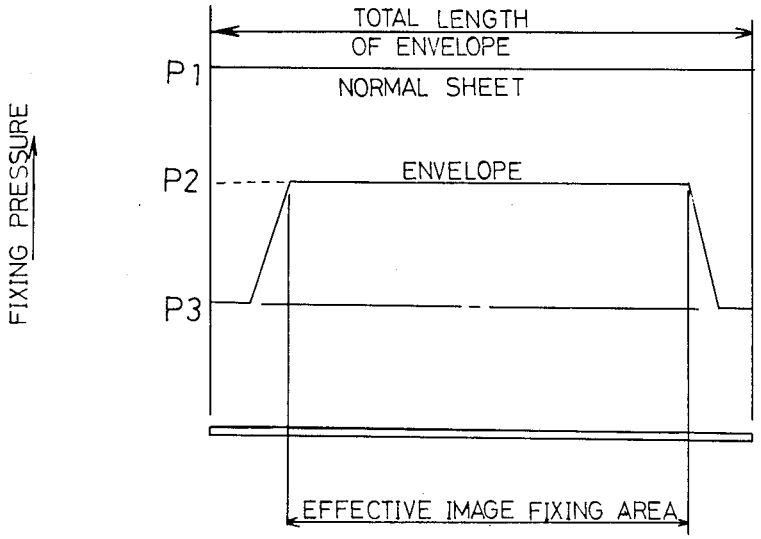
FIG. 2 is a graph showing fixing pressures produced respectively when a normal sheet of paper and an envelope are fixed according to the invention.

Furthermore, as shown in FIG. 2, it is desirable not only to make a fixing pressure P2 for an envelope lower than a separate fixing pressure P1 for a normal sheet of paper, but also to make a further fixing pressure P3 at the leading and trailing edges of the envelope still lower than the fixing pressure P2 in an effective image fixing area among the full length thereof. As the result of the lowest pressures at both ends, not only the leading edge of an envelope can be easily picked up by a nip between both rollers, but also even the trailing edge where is no way of relieving deformation developed can smooth pass through the pair of rollers without crumpling or tearing off.

Figure 3:
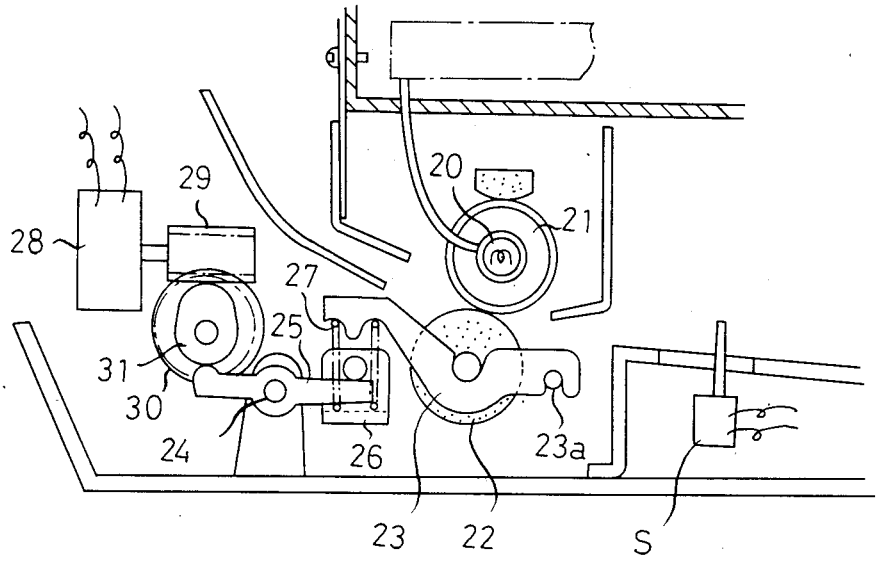
FIG. 3 is a front view of an embodiment of a fixing device according to the invention.
Figure 4:
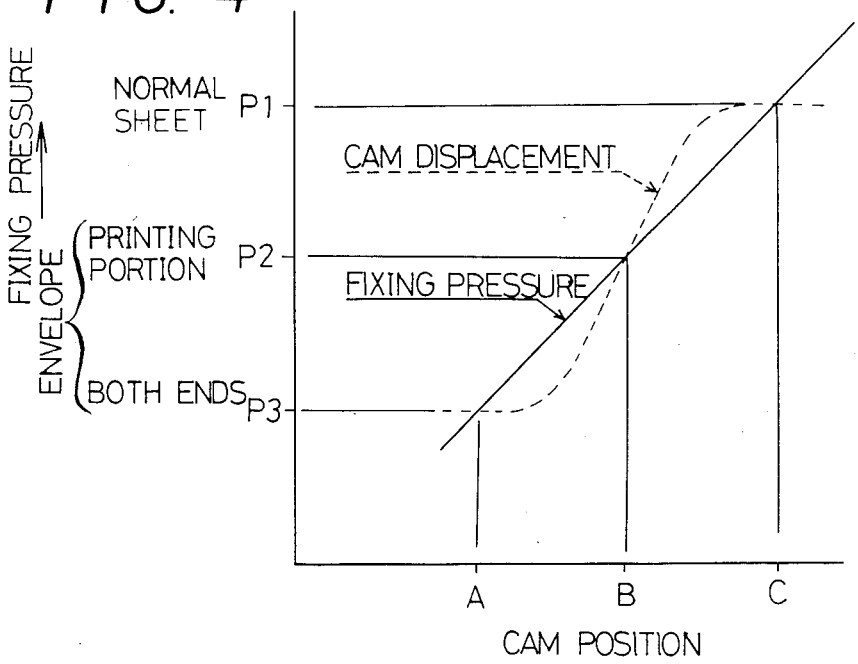
FIG. 4 is a graph showing the relation of cam displacement and fixing pressure corresponding to cam position of a cam shown in FIG. 3.

Changing the fixing pressures mentioned above is achieved, for example, by a mechanism as shown in FIG. 3, where a fixing roller 21 is journalled in bearings at a given position in an upper unit 2 of a printing apparatus, and both ends of a pressure roller 22 are supported with levers 23. One end of the lever 23 is rotatably supported by means of a pin 23*a* secured to the upper unit 2, and the other end is supported by a compression spring 27, the lower end of which is supported by a spring receiver 26 held by one end of a lever 25 rocking around a supporting point 24 fixed to a lower unit 1. With the upper and lower units 1 and 2 being closed, the lever 23 is forcedly pushed up by the compression spring 27, which results in exerting pressure upon both the rollers 21 and 22. The left end of the lever 25 is engaging with a cam 31 rotated by a worm wheel 30 through a worm 29 driven by a stepping motor 28. Therefore, the compression spring 27 is compressed in accordance with an amount of projection of the cam 31 at an engaging point, which results in changing fixing pressure between both rollers. As shown in FIG. 4, fixing pressures are set to the values P3, P1 and P2 in FIG. 2, respectively at the position A of a minimum displacement of the cam 31, at the position C of a maximum displacement of the cam 31 and at the intermediate position B between A and C. Thus if the rotation angle of the cam is controlled as to hold the cam at the position C when fixing a normal sheet, as well as at the position A for both leading and trailing edges and at the position B for the effective image fixing area when fixing an envelope, the three fixing pressures shown in FIG. 2 can be obtained.

Figure 5A:
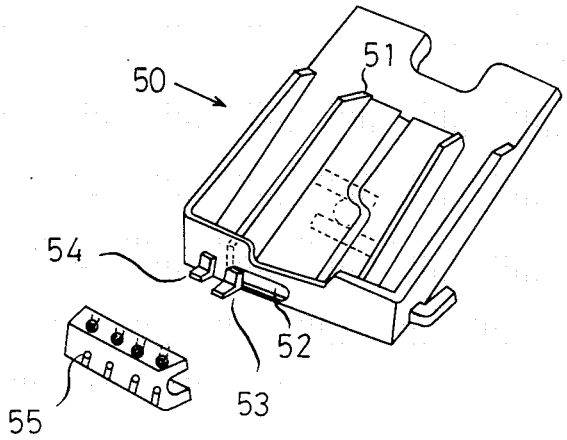
FIGS. 5*a* and 5*b* are perspective views respectively showing cassettes for supplying envelopes and normal sheets of paper.
Figure 5B:
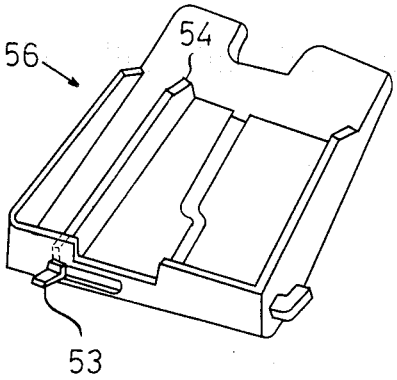

Aforesaid control for fixing pressure is carried out as follows:

As a means for determining whether a transfer member is a normal sheet of paper or for example an envelope, a cassette 50 for supplying envelopes includes, as shown in FIG. 5*a*, a tongued piece 54, for a sign of the cassette 50 for envelopes, attached to the front end thereof, in addition to a separate tongued piece 53, for detecting the size of transfer members (here, envelopes), provided integrally with a movable side fence 51 in the cassette 50. The side fence 51 can be moved to meet the width of transfer members (here, envelopes), and the tongued piece 53 projects out through a slit 52 in the front end wall of the cassette 50. When the cassette 50 is set for a certain width of envelopes, the envelope-detection tongued piece 54 can be identified by a photoelectric sensor 55 disposed at a position opposite thereto in the apparatus. Although another cassette 56 for supplying normal sheets of paper includes, as shown in FIG. 5*b*, includes a further tongued piece 53, for detecting the size of paper, moving together with another side fence 51, it has no tongued piece 54, because it is for normal paper. So, it is easy not only to identify whether a cassette is for envelopes or for normal sheets, but also to know of the size of envelopes or normal paper to be supplied.

Figure 6:
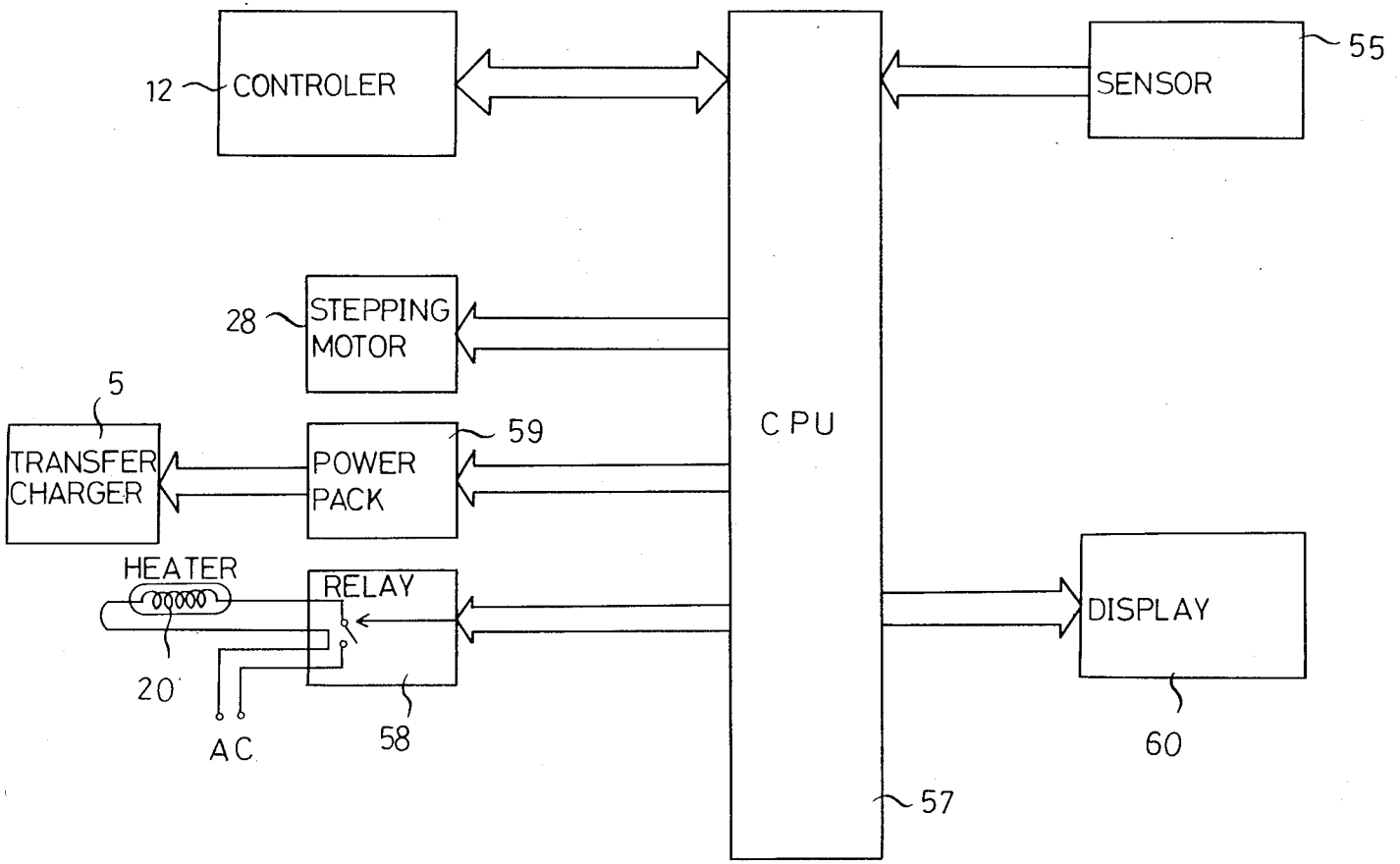
FIG. 6 is a control block diagram of the embodiment in FIG. 3.

The results of the detection by the sensor 55 are inputted into and processed by a CPU 57, as shown in FIG. 6. The CPU 57 will select, for instance, an envelope mode according to the processing. As shown in FIG. 3, since the time when the loading edge of an envelope has been detected by a sensor S disposed at a position upstream of the fixing device, the rotating angle position of aforesaid stepping motor 28 is controlled to a preset timing for every sizes of envelope. A device for other purposes having been provided on a sheet feed path can be made use of instead of the sensor S. Consequently, a fixing pressure for the envelope mode is reduced under that for normal sheets, so it is desirable to raise the temperature of the heater 20 via a relay 58 so as to compensate for the loss of fixing pressure owing to the reduced fixing pressure.

Figure 7:
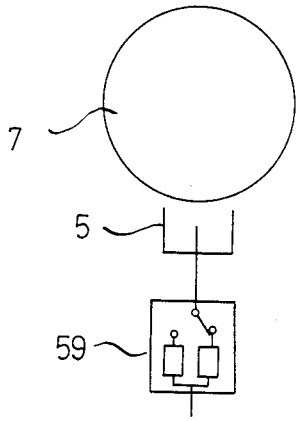
FIG. 7 is a schematic representation showing a configuration of a transfer portion of the embodiment in FIG. 3.

When the toner image formed on the photosensitive drum is transferred to an envelope, since the surface to be transferred would be charged through plural sheets of paper and air layers, the transfer current of the transfer charger 5 must be increased to charge the sheet to a fixed-level of electric charge. Therefore, as schematically shown in FIG. 7, the transfer charger 5 has been connected to a power pack allowing the transfer current to be changed. As shown in FIG. 6, this change is controlled by the output of the CPU 57, based on the input of the signal to the CPU 57 issued from the sensor 55 after detecting the kind of articles to be transferred, i.e. normal sheets of paper or an envelope. The transfer current for printing an envelope has been set on the pack to an optimized value of electric charge for the surface of envelope. Furthermore, in envelope mode, the CPU instructs the controller 12 in data writing timing, based on the information of envelope size and paper feed timing stored on its memory, and indicates what sort of mode is going on, i.e. envelope mode or normal paper mode, on a display 60.

Figure 8:
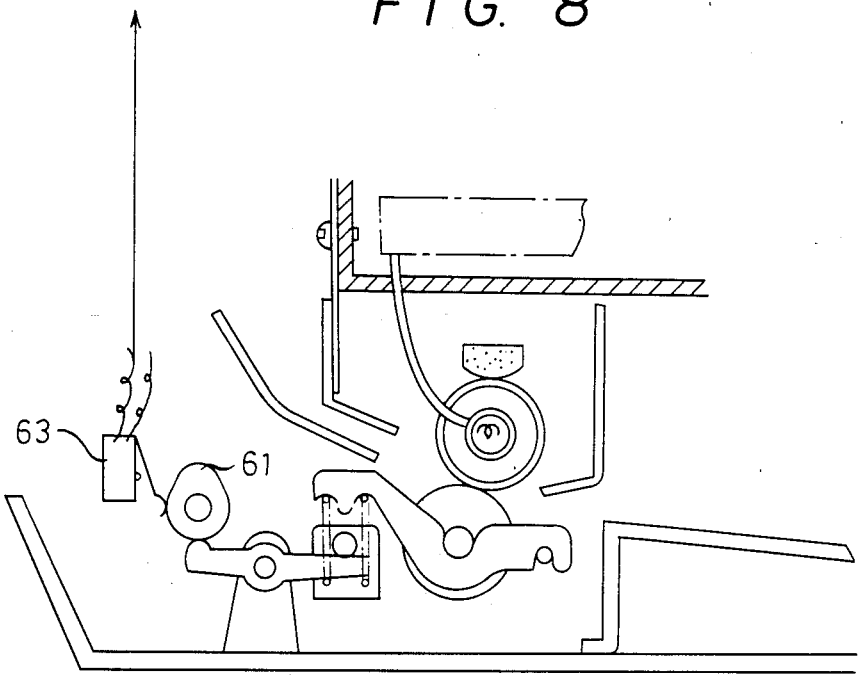
FIG. 8 is a front view showing another embodiment of a fixing device according to the invention.
Figure 9:
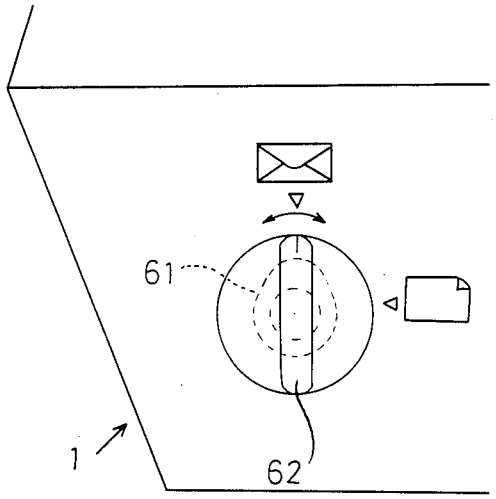
FIG. 9 is an enlarged front view showing the knob and around it in FIG. 8.
Figure 10:
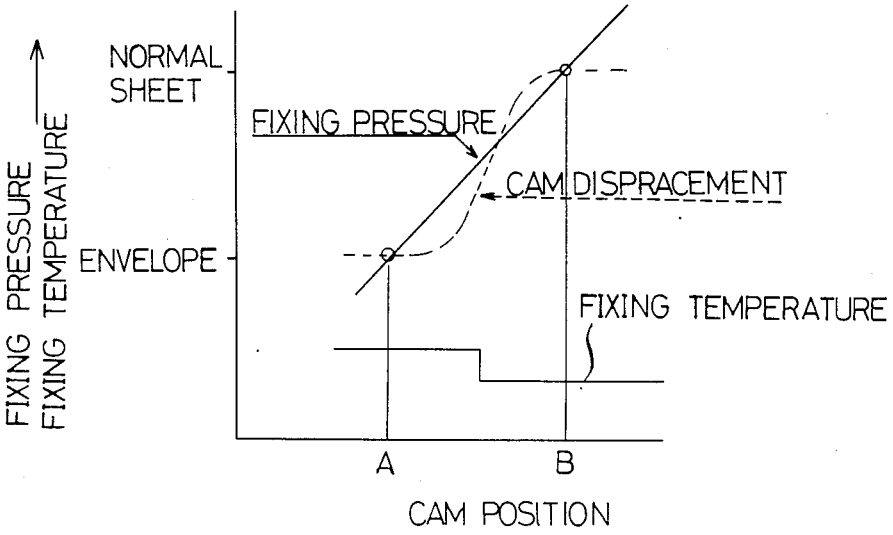
FIG. 10 is a graph showing the relation of cam displacement, fixing pressure and fixing temperature corresponding to cam position of the cam in FIG. 8.
Figure 11:
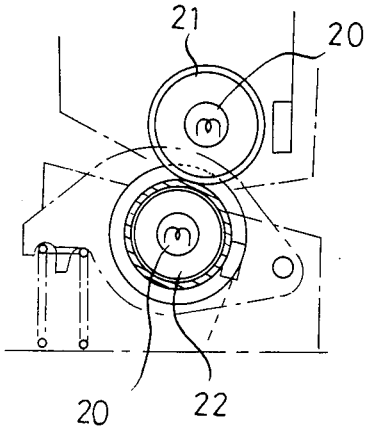
FIG. 11 is a front view showing a further embodiment of a fixing device according to the invention.

Change of fixing pressure from envelope mode to normal sheet mode or vice versa can be performed manually, without displacing the cam by the stepping motor energized by the detect signal reporting the sort of transfer article via CPU. In this case, another cam 61 (FIG. 8) placed at the same position as that of the cam 31 in FIG. 3 can be displaced by manually turning a knob 62 installed on the cam shaft on the outside of the housing, as shown in FIG. 9. It is desirable to indicate the respective set positions of the knob for envelope and normal sheet modes near the knob 62 by means of pictograph or letters, as shown in FIG. 9. In this connection, since it may not be practical for the operator to take the trouble of lowering the pressure manually on the leading and trailing edges of envelope, it is preferable to set cam positions only at two points, A and B (as shown in FIG. 10), for alternative use in envelope and normal sheet modes, and, in envelope mode, to interlock heater output with low fixing pressure so as to raise fixing temperature. And, as shown in FIG. 8, the motion of the cam 61 turns ON/OFF a switch 63 which serves as an envelope mode sensor to input the information to the host computer. In addition, in envelope mode and with the fixing device wherein the fixing roller 21 alone is provided with the heater 20, since the heat may be sufficient to melt the toner but insufficient to be transmitted up to the pressure roller, heat expansion in the upper sheet of envelope differs from the lower one, which may cause distortion of the envelope. Therefore, if the envelope should be rolled as it is, ripples might be developed. Accordingly, as shown in FIG. 11, it is desirable to provide the heater 20 not only in the fixing roller 20 but also in the pressure roller 22 so as to heat both of them in envelope mode.

Figure 12A:
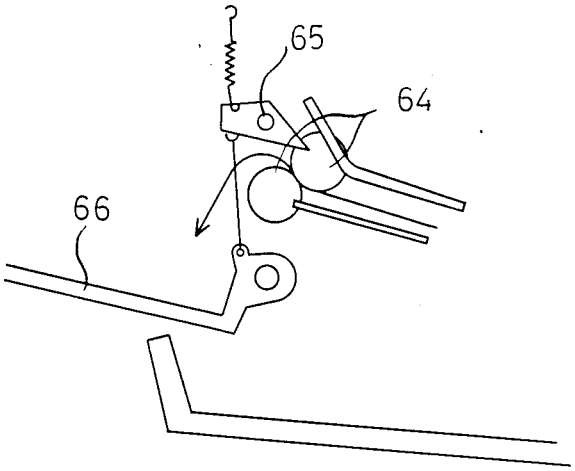
FIGS. 12*a* and 12*b* are sectional views respectively showing examples of discharge path of paper fixed; the former shows an open status of a discharge sheet stacker for envelopes and the latter a closed status.
Figure 12B:
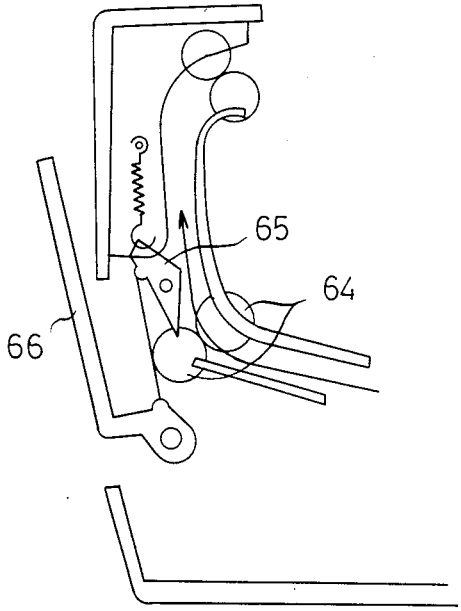

And, because such articles as envelopes are difficult to be bent, and it is not practical to make a U-turn after fixing and discharge them to the sheet stacker 19 placed on the top of the apparatus, it is desirable, as shown in FIG. 12*a*, to provide a switching gate 65 for changing feed direction to a direction capable of discharging envelopes as they are rolled out from a discharging rollers 64 of the fixing device, as well as a collapsible sheet stacker 66 receiving them discharged in the switched direction by this switching gate 65. FIG. 12*a* shows the condition where the sheet stacker 66 is ready for envelope mode, and FIG. 12*b* the one where the sheet stacker 66 has been folded. Preferably, this change is performed either by the automatic control of the CPU receiving the detect signal of the sensing tongued piece 53 on the supply sheets cassette, or through the relay interlocking with the turn of the knob 62 in FIG. 9.

As mentioned above, an electrostatic printing apparatus according to the invention enables the toner image which has been transferred to such an article to be printed, as an envelope made up of two or more sheets of paper, to be successfully fixed for printing, thus implementing an electrostatic printing apparatus successfully direct printing addresses on envelopes to greatly encourage office automation.

It will be obvious to those skilled in the art that various changes may be made in the invention without departing from the spirit and scope thereof and therefore the invention is not limited by that which is shown in the drawings and described in the specification but only as indicated in the appended claims.

What is claimed is:

1. An electrostatic printing apparatus having a fixing device wherein a transfer member, holding an unfixed toner image, is passed through, between a pair of rollers pressed down with each other and provided with a heat source within one of said rollers, for fixing said toner image, and wherein said transfer member can comprise a first kind which is a normal sheet of paper or a second kind which is a composite made up of plural layers of paper, comprising:

means permitting the fixing pressure applied to the transfer member passing between said pair of rollers in said fixing device to be changed from a fixing pressure suitable for a normal sheet of paper to another fixing pressure, lower than said fixing pressure, suitable for a composite made up of plural sheets, and vice versa; and means for changing said fixing pressure according to whether said transfer member is a normal sheet of paper or a composite.

2. An apparatus as claimed in claim 1, wherein said means for changing the fixing pressure is a knob turned manually.

3. An apparatus as claimed in claim 1, wherein said means for changing the fixing pressure comprises means for detecting said transfer member and for generating a signal indicative of the kind of the detected transfer member; and means for controlling the fixing pressure in accordance with said signal generated by said detecting means.

4. An apparatus as claimed in claim 1, wherein said means for changing the fixing pressure comprises means for detecting the kind and size of said transfer member and for generating a signal indicative of the detected kind and size;

means for controlling the fixing pressure in accordance with said signal generated by said detecting means; and when said member is a composite having an effective image area which is less than the total area of one side of the transfer member, said fixing pressure is so controlled that leading and trailing portions of the transfer member outside the effective image area are subjected to fixing pressure lower than that for said effective image area.

5. An electrostatic printing apparatus having a fixing device wherein a transfer member, holding an unifixed toner image, is passed through, between a pair of rollers pressed down with each other and provided with a heat source within one of said rollers, for fixing said toner image, comprising:

means for changing the fixing pressure applied between said pair of rollers in said fixing device;

means for changing the heat generated from said heat source; and means for switching both said fixing pressure and said heat interlocked with each other, so that, when said member is a sheet of paper, said fixing pressure is set to a given high pressure and said heat is set to a given low value, while, when said member is a composite made up of plural layers of paper, said fixing pressure is set to a given low pressure and said heat is set to a given high value.

6. An apparatus as claimed in claim 5, wherein said switching means is a knob turned manually.

7. An apparatus as claimed in claim 5, wherein said switching means comprises means for detecting the transfer member and for generating a signal related to whether the member comprises a single layer of paper of multiple layers of paper; and means for controlling both said fixing pressure and said heat interlocked with each other in accordance with said signal generated by said detecting means.

8. An electrostatic printing apparatus in which a toner image formed on a photosensitive member is transferred to a transfer member by a transfer charger, and said transfer member holding an unfixed toner image, is passed through, between a pair of rollers pressed down with each other and provided with a heat source within one of said rollers, for fixing, wherein:

the transfer current of a transfer charger can be changed between a current suitable for transferring to a normal sheet of paper and another one suitable for transferring to a composite made up of plural sheets; and fixing pressure applied to between said pair of rollers can be changed between two pressures suitable respectively for the sort of mode of said transfer members; and provided are means for detecting the sort of mode of said transfer member; and means for controlling, based on a signal of said detecting means, said transfer current and said fixing pressure to those suitable for the sort of mode of said transfer member indicated by said detect signal.

9. An electrostatic printing apparatus having a fixing device wherein a transfer member, holding an unfixed toner image, is passed through, between a pair of rollers pressed down with each other and provided with a heat source within one of said rollers, for fixing; a U-turn path guiding a transfer member discharged from said fixing device to a first sheet stacker installed on top of the apparatus; a second sheet stacker installed nearly in the discharge direction of said member discharged from said fixing device; and a switching gate for changing a path of said member discharged from said fixing device between said U-turn path and a path to said second sheet stacker, wherein:

a fixing pressure applied to between said pair of rollers in said fixing device can be changed between fixing pressures suitable respectively for said member of a normal sheet and for said member of a composite made up of plural sheets; and provided is means for interlocking said changing of said fixing pressure and said changing of said switching gate, so that, when said member is a normal sheet of paper, fixing pressure is changed to one suitable for the member as well as said switching gate is changed to one position guiding the member to said U-turn path, while, when said member is a composite, fixing pressure is changed to the other suitable for said transfer member as well as said switching gate is changed to the other position guiding the transfer member to said second sheet stacker.

10. An electrostatic printing apparatus comprising means for forming a latent image, means for developing the latent image to form a developed image and for transferring the developed image to a transfer member which can vary in kind between a normal transfer member comprising a single sheet of paper and a composite transfer member comprising multiple layers of paper, and a fixing device which comprises a pair of rollers forming a nip through which the transfer member can pass to fix the image transferred thereto, wherein at least one of the rollers has a heat source for heating the roller, and means for changing the pressure at said nip to thereby apply one pressure when the transfer member comprises a single sheet of paper and another, different pressure when the transfer member passing through said nip comprises multiple sheets of paper.

11. A printing apparatus as in claim 10 including means for detecting the kind of transfer member for generating a signal as a result of said detecting which is indicative of the kind of transfer member and for controlling said pressure at said nip in accordance with said signal.

12. A printing apparatus as in claim 11 including means for controlling the heat at said nip in accordance with said signal.

13. A printing apparatus as in claim 12 including means for applying a transfer current of a first level or of a second level in accordance with said signal when transferring said developed image to said transfer member.

14. A printing apparatus as in claim 13 including means operative when said transfer member comprises multiple sheets of paper to apply a first pressure at a leading and at a trailing portion of the transfer member and a second pressure to the remainder of the transfer member.

* * * * *